United States Patent [19]

O'Brien

[11] 4,095,290

[45] Jun. 20, 1978

[54] COLD WEATHER MASK

[75] Inventor: Robert G. O'Brien, Northbrook, Ill.

[73] Assignee: Thermo Industries, Inc., Glenview, Ill.

[21] Appl. No.: 747,648

[22] Filed: Dec. 6, 1976

[51] Int. Cl.[2] ..... A41D 13/00

[52] U.S. Cl. ..... 2/9; 2/174

[58] Field of Search ..... 2/174, 8, 9, 202

[56] References Cited

U.S. PATENT DOCUMENTS

| | | | |
|---|---|---|---|
| 3,276,035 | 10/1966 | Jacobson | 2/13 |
| 3,768,100 | 10/1973 | Coleman et al. | 2/206 |
| 3,878,563 | 4/1975 | Pulju | 2/9 |

*Primary Examiner*—Doris L. Troutman

*Attorney, Agent, or Firm*—Vogel, Dithmar, Stotland, Stratman & Levy

[57] ABSTRACT

A flexible face mask formed to cover the face having openings for the eyes, nose and mouth, the nose opening having a protective flap thereover. The mask body is made of a three-part laminate with an inner water-absorbent cotton, wool or man-made material, an intermediate thermal barrier of polyurethane foam and an outer reflective layer of aluminum or metalized polyethylene, vinyl or Milar film. The mask is provided with forehead and chin pockets to insure a tight fit. Openings are also provided in the mask to accommodate the templates of eye glasses or goggles.

9 Claims, 3 Drawing Figures

COLD WEATHER MASK

BACKGROUND OF THE INVENTION

Snowmobilers, football fans, ice fishermen and the like, participate in their activities during very cold or subzero weather and accordingly, it is necessary to wear a protective mask to prevent the face from freezing. The ideal mask should be one which fits closely to the face and which accommodates a wide variety of facial characteristics while at the same time providing adequate protection to the wearer. Preferably, the mask should be made of a light weight material which is readily foldable for storage in the pocket of a winter garment. It is necessary for the mask to provide both warmth and protection from the wind.

A variety of prior art masks are described in patents, such as U.S. Pat. No. 3,878,563, issued Apr. 22, 1975, to Pulju; U.S. Pat. No. 3,768,100, issued Oct. 30, 1973, to Colman et al.; and U.S. Pat. No. 3,740,767, issued June 26, 1973, to Schuessler. While each of these patents describes a mask which is adequate, none of the patents provides all the features set forth above for the most desirable mask for cold weather protection.

SUMMARY OF THE INVENTION

The present invention relates to a protective face mask including a flexible and body portion formed to cover the face with eye, nose and mouth openings formed therein with a flexible nose flap fixed to the outer surface of the body portion, the face mask material being a laminate of an inner layer of water-absorbent material, a middle thermal barrier, and a metal reflective outer layer.

The mask is attached to the wearer's head by means of a stretchable elastic band and there are provided slits in the face mask to accommodate the templates of sun glasses, goggles or the like. In addition, the mask material is thin and flexible enabling the entire mask to be rolled up in a ball and stored in little space.

It is a principal object of the present invention to provide a mask for cold weather use which is flexible and easily stored.

It is another object of the present invention to provide a mask for cold weather protection with a metalized outer reflecting surface which improves the insulating properties of the mask.

It is a further object of the present invention to provide a cold weather face mask comprising a flexible, thermally insulating facepiece adapted to cover and closely engage the face of the wearer of said face mask, said facepiece having a visual port, a nose port and a mouth port therein, means forming a forehead pocket to assure close fitting of the top of said mask to the forehead of the wearer, means forming a chin pocket to assure close fitting of said mask to the chin of said wearer, a nose flap connected to the outer surface of said ski mask overlying said nose port to cover the nose of the wearer, said facepiece and said nose flap constructed of a three-part laminate having a moisture absorbent innerlayer laminated to a thermal barrier having a metalized outer layer.

These and other objects and advantages of the present invention will become more apparent when considered in connection with the accompanying detailed description thereof in conjunction with the appended drawings in which:

DESCRIPTION OF THE PREFERRED EMBODIMENTS

Figure 1:
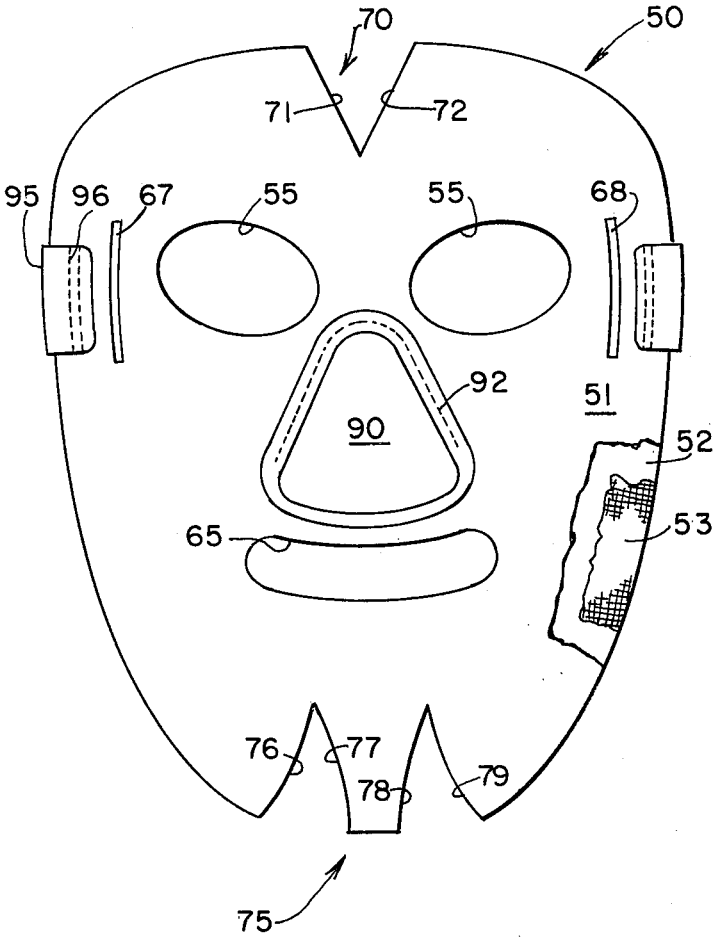
FIG. 1 is a front plan view showing the face mask of the present invention with the forehead and chin pockets yet to be formed.
Figure 2:
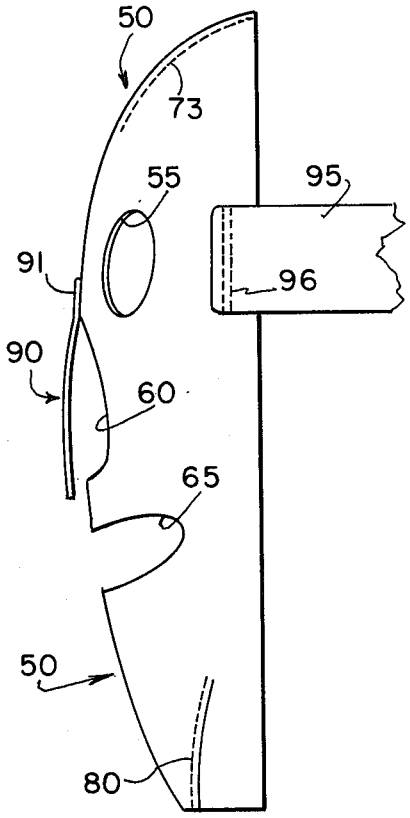
FIG. 2 is a side elevational view of the face mask illustrated in FIG. 1, with the forehead and chin pockets formed.
Figure 3:
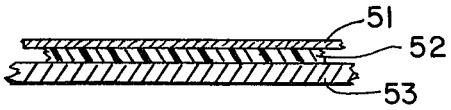
FIG. 3 is a section view of the material forming the face mask.

Referring now to the drawings, there is disclosed a face mask 50 which is primarily made of a three-part laminate comprised of a metalized outer layer 51 completely covering a polyurethane thermal barrier 52 which is laminated to a water or moisture absorbent material 53 such as a cotton flannel. Spaced apart eye ports 55 are provided in the upper portion of the face mask and a nose port 60 is formed slightly below the eye ports 55 and intermediate thereof. A mouth port 65 is provided below the nose port 60 and is of sufficient dimension to free the wearer's mouth for talking and breathing. Spaced apart slits 67 and 68 are provided between a respective one of the eye ports 55 and the adjacent side edge of the mask 50, the slits 67 and 68 being of such dimension to accommodate the templates of eye glasses, sun glasses or goggles.

A pie-shaped portion 70 of the mask 50 is cut out leaving diagonally intersecting side edges 71 and 72 in the forehead portion of the mask. When the side edges 71 and 72 are sewn, as at 73, there is formed a pocket to accommodate the forehead of a wearer. The chin 75 is formed of a trifurcated portion in which there are present side edges 76 and 77 and 78 and 79, which when sewn together as at 80 form a protective chin pocket to fit snugly around the chin of a wearer. The chin pocket is deeper and more angular than is the forehead pocket.

A nose flap 90 generally triangular in shape has an outer flange 91 extending therearound which is sewn as at 92 to the face mask 90 around the periphery of the nose port 60, thereby to provide protection for the nose of the wearer of the mask. An elastic head band 95 is fixedly connected to the side edges of the mask 50 as by double stitching 96 to insure close and snug fitting of the mask 50 to the head of a wearer. The elastic band 95 may be made of any well recognized material.

The body of the mask 50 is made of the three-part laminate previously described, with the inner part being a moisture absorbent material such as cotton flannel. Other cotton, natural or man-made fiber materials are acceptable. The center layer is a thermal barrier and may be an open cell polyurethane foam, whereas the outer material is a light reflective material such as aluminum which can be applied to the surface of the outer layer, by means of a vacuum misting deposition. The mask material has a thickness of about 1/32 of an inch and it is foldable or may be crumpled to a small ball for storage in a pocket. The outer metal layer 51 is of utmost importance, since it seals the polyurethane thermal layer and greatly improves the wind resistance of the mask 50. The outer layer 51 is a metalized synthetic organic resin, such as polyethylene, polyvinyl chloride or Milar. The metal preferably is aluminum.

From the foregoing, it will be seen that there has been provided a cold weather mask which fits closely to contours of a wearer's face and particularly fits closely to both the forehead and the chin. The nose flap provides adequate protection for the nose of the wearer. The entire construction is made of a three-part laminate which is extremely warm and very thin, the preferred material having a thickness of about 1/32 of an inch, and yet which may be crumpled into a ball for storage in a small space. The entire construction is wind resistant and provides excellent thermal insulation while at the same time the inner cotton flannel layer absorbs any perspiration generated by the wearer during exercise, thereby preventing coldness due to evaporation of the perspiration from the skin.

While there has been described what is at the present to be considered to be the preferred embodiment of the present invention, it will be understood that various modifications and alterations may be made therein without departing from the true spirit and scope of the invention and it is intended to cover such alterations and modifications in the appended claims.

What is claimed is:

1. A cold weather face mask comprising a flexible, thermally insulating facepiece adapted to cover and closely engage the face of the wearer of said face mask, said facepiece having a visual port, a nose port and a mouth port therein, only a single V-shaped notch forming a forehead pocket to assure close fitting of the top of said mask to the forehead of the wearer, only two spaced apart V-shaped notches with a rectangular insert therebetween forming a chin pocket to assure close fitting of said mask to the chin of said wearer, a nose flap connected to the outer surface of said ski mask overlying said nose port to cover the nose of the wearer, said facepiece and said nose flap constructed of a three-part laminate having a moisture absorbent inner-layer laminated to a thermal barrier having a metalized outer layer.

2. A cold weather face mask set forth in claim 1, wherein apertures are provided at the side of said mask near said visual port to accommodate the templates of eye glasses.

3. The cold weather face mask set forth in claim 1, and further comprising an elastic band connected near the side edges of said mask to maintain said mask in place on a face of a wearer.

4. The cold weather face mask set forth in claim 1, wherein said visual port is comprised of spaced apart openings.

5. The cold weather face mask set forth in claim 1, wherein said inner layer is cotton flannel.

6. The cold weather face mask set forth in claim 1, wherein said thermal barrier is an open cell polyurethane foam.

7. The cold weather face mask set forth in claim 1, wherein said outer layer is metalized plastic film.

8. The cold weather face mask set forth in claim 1, wherein said metalized outer layer is aluminum vacuum misted on the surface of the outer layer.

9. The cold weather face mask set forth in claim 1, wherein said facepiece is 1/32 of an inch in thickness.

* * * * *